United States Patent [19]

Wooten

[11] Patent Number: 4,530,361

[45] Date of Patent: Jul. 23, 1985

[54] ADJUSTABLE BRASSIERE

[75] Inventor: Thomas P. Wooten, Brooklyn, N.Y.

[73] Assignee: International Playtex, Inc., Stamford, Conn.

[21] Appl. No.: 634,340

[22] Filed: Jul. 25, 1984

[51] Int. Cl.[3] ..... A41C 3/00

[52] U.S. Cl. ..... 128/483; 128/510

[58] Field of Search ..... 128/483, 425, 499, 492, 128/490, 510, 509

[56] References Cited

U.S. PATENT DOCUMENTS

| | | | |
|---|---|---|---|
| 1,575,989 | 3/1926 | Haven . | |
| 1,958,963 | 5/1934 | de Got . | |
| 2,067,354 | 1/1937 | Spare . | |
| 2,390,465 | 12/1945 | Russo . | |
| 2,454,153 | 11/1948 | Glick | 128/483 UX |
| 2,553,225 | 5/1951 | Weaver et al. . | |
| 2,970,597 | 2/1961 | Michel . | |
| 3,322,127 | 5/1967 | Sachs . | |
| 3,378,013 | 4/1968 | Bruno | 128/510 |
| 3,459,190 | 8/1969 | Frischer et al. . | |
| 3,896,818 | 7/1975 | Locascio . | |
| 3,981,310 | 9/1976 | Donaghy . | |
| 4,091,819 | 5/1978 | Huber et al. . | |
| 4,372,322 | 2/1983 | Stern et al. . | |
| 4,393,875 | 7/1983 | O'Boyle et al. . | |
| 4,411,269 | 10/1983 | Weintraub . | |

OTHER PUBLICATIONS

Package for SUSA Brassiere called Der Moderne Still-BH.

Package for Warner's Brassiere called The Wrap.

*Primary Examiner*—Doris L. Troutman

*Attorney, Agent, or Firm*—Stewart J. Fried

[57] ABSTRACT

An adjustable brassiere is provided which includes two independent breast retaining cups, each of said cups having at least one adjusting band attached thereto. Fastening means are provided which are attached to at least one end of each of the adjusting bands. A body encircling band is attached to the breast retaining cups along the bottom edges thereof and it includes adjustable back closure means, which are adapted to permit the back width of the brassiere to be adjusted to accommodate different wearers. Securing means are provided at multiple positions along said body encircling band. Each of the fastening means is adapted to engage the securing means at at least one of the multiple positions. The volume of each of the breast retaining cups and the amount of breast separation and garment coverage is determined by the position at which the fastening means engages the securing means.

13 Claims, 5 Drawing Figures

ADJUSTABLE BRASSIERE

BACKGROUND OF THE INVENTION

The present invention relates generally to an adjustable brassiere and, more particularly, to such a brassiere which is not only capable of providing adequate support for the wearer but, in addition, is extremely comfortable to wear, provides a custom fit for different sized wearers and may be worn under a variety of different fashion dresses and tops.

While a brassiere must be able to provide adequate support, a factor considered by many women in selecting such a garment is the ability of the garment to be able to be adjusted both as to breast retaining cup size and amount of garment coverage. Heretofore, adjustable brassieres were extremely limited in the type of adjustments which could actually be made. For example, most of the garments which permitted cup size adjustment did not permit independent adjustment of back width, of breast separation or cleavage or of garment coverage.

Brassieres which were able to be adjusted to control the size of the breast retaining cups have been marketed for many years. Most of these garments, however, utilize front closure means which serve to not only fasten or secure the brassiere but, in addition, permit some adjustment to be made to the size or volume of the breast retaining cup. An example of such a front closure garment is described in U.S. Pat. No. 2,970,597 which issued to J. M. Michel on Feb. 7, 1961 for Body Encircling Garments. The garment described in the Michel patent includes tabs having fastener elements located at their respective ends which are adapted to engage slits located below the opposite breast retaining cup. The fastener elements are the primary closure means for the brassiere and, as such, they control both breast retaining cup size and back width. See, also U.S. Pat. Nos. 1,575,989 which issued on Mar. 9, 1926 to Grace Van Allen Haven for a Brassiere; 1,958,963 which issued on May 15, 1934 to Laina de Got for a Brassiere; 2,390,465 which issued on Dec. 4, 1945 to Florence Russo for an Undergarment; and 3,459,190 which issued on Aug. 5, 1969 to Blanche Frischer et al. for Foundation Garments.

During the past few years, Warner introduced an adjustable brassiere known as "The Wrap" which is a front closure, soft cup brassiere having a 5 hook adjustable front closure. Exquisite Form markets a brassiere known as its "Adjust To Fit" brassiere which is claimed to have a "customized degree of plunge" and "adjustable cup volume for fit". Such garments, however, have limited adjustability and their adjustment means are both bulky and not especially secure. Similarly, a nursing brassiere was introduced in West Germany by Susa-Werke called Der Moderne Still-BH which permits each of the breast retaining cups to be separately opened to permit access for nursing.

These both prior art adjustable brassieres all utilized front closure means to control cup volume and back width. None of the garments disclosed in these patents permit independent adjustability for cup size and back width.

Similarly, those prior art brassieres which incorporate back closures to control back width have not, heretofore, permitted independent adjustability of cup size or the ability to control breast separation and cleavage to permit the garment to be worn underneath a variety of different outer garments. For example, the brassiere described in U.S. Pat. No. 3,378,013, which issued to Enrico Bruno on Apr. 16, 1968 for a Brassiere With Lower Cup Framing Adjustment, while including a pair of longitudinally adjustment bands 10 for adjusting the garment to accommodate women with out of standard rib cages, is incapable of being adjusted to control separation and cleavage since both of the breast retaining cups are attached together. See, also, U.S. Pat. No. 2,454,153 which issued to Jack Glick on Nov. 16, 1948 for a Brassiere; U.S. Pat. No. 2,553,225 which issued to Roy Blaine Weaver et al. on May 15, 1951 for a Brassiere; and U.S. Pat. No. 2,067,354 which issued to Lola Spare on Jan. 12, 1937 for a Brassiere. Each of the brassieres described in these patents include adjusting means for controlling the size or volume of the individual breast retaining cups and a back width adjustment. The breast retaining cups are, however, permanently attached together and, as such, do not permit adjustment of breast separation and cleavage, thus preventing the garments from being worn under different fashion garments.

The adjustable brassieres described in the prior art, while each offering some degree of adjustability, all fail to provide the optimal adjustable brassiere, i.e., one which provides a true comfort fit by permitting independent adjustment of the size or volume of the breast retaining cups; by permitting independent adjustment of the back width; by permitting control of the amount of garment coverage, i.e., the center height of the brassiere measured between the breast retaining cups, to permit the garment to be worn under a wide variety of outer garments; and by permitting control of breast separation and cleavage.

SUMMARY OF THE INVENTION

Against the foregoing background, it is a primary object of the present invention to provide a brassiere which is capable of being adjusted for customized fit and for fashion versatility.

It is another object of the present invention to provide such an adjustable brassiere which provides adequate support to the wearer.

It is yet another object of the present invention to provide such an adjustable brassiere which is attractive in appearance.

It is still yet another object of the present invention to provide such an adjustable brassiere which permits the wearer to be able to independently adjust the volume or size of the breast retaining cups, the amount of breast separation and/or cleavage, amount of the garment coverage and the back width.

It is yet still another object of the present invention to provide such a brassiere which may be worn under a number of different garments.

It is still yet another object of the present invention to provide such a brassiere which permits independent adjustment of each breast retaining cup to compensate for temporary or transient changes in bust size.

These and other objects of the present invention are attained by providing an adjustable brassiere having two independent breast retaining cups, each of which have at least one adjusting band attached thereto. Fastening means are attached to at least one end of each of said adjusting bands. A body encircling band is provided and is attached to the breast retaining cups along the bottom edges thereof. Adjustable closure means are provided at the opposite ends of the body encircling band, to permit the back width of the brassiere to be adjusted. Securing means are provided at multiple positions along the body encircling band. Each of the fastening means are adapted to engage the securing means at any one of the multiple positions, with the volume of each of the breast retaining cups being determined by the particular position which is engaged by the fastening means. It will be appreciated that by repositioning each of the fastening means, the volume of the breast retaining cup as well as the amount of breast separation and/or cleavage can be changed. Similarly, the back width can be adjusted by the adjusting closure means at the ends of the body encircling band.

Other objects, advantages and novel features of the present invention will become apparent from the detailed description of the invention when considered in conjunction with the accompanying drawings.

DESCRIPTION OF THE PREFERRED EMBODIMENTS

Figure 1:
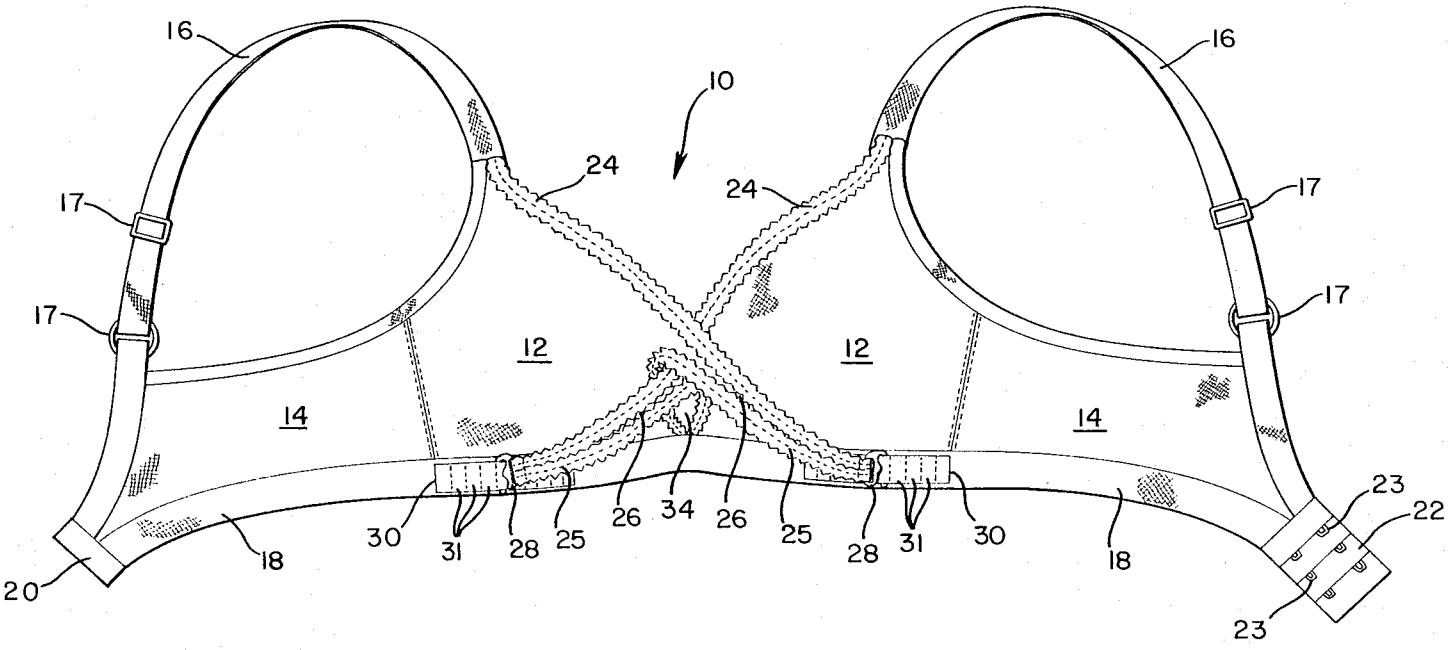
FIG. 1 is a front elevational view of an adjustable brassiere incorporating the principles of the present invention.
Figure 2:
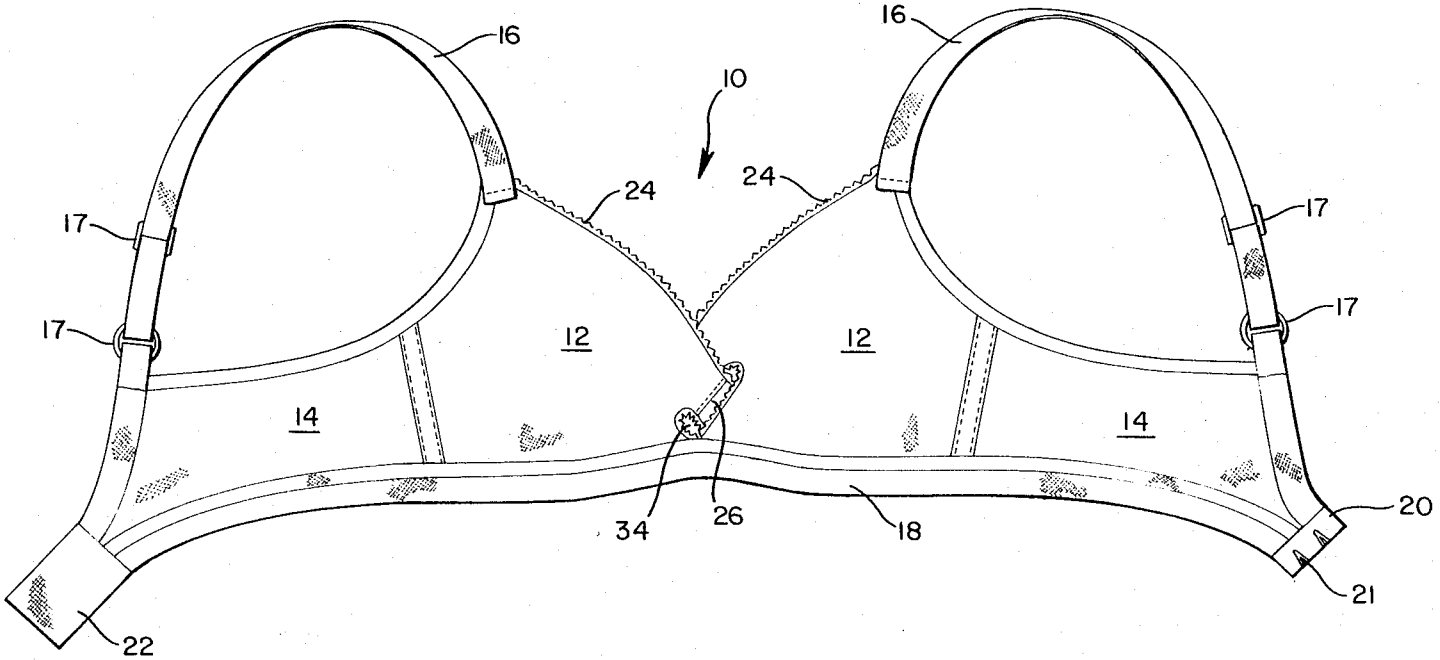
FIG. 2 is a rear elevational view of the brassiere of FIG. 1.

The adjustable brassiere 10 of the present invention, as shown in FIGS. 1 and 2, includes a pair of breast receiving or retaining cups 12, a pair of side panels 14 extending outwardly from the breast retaining cups 12, a pair of shoulder straps 16 each including adjusting means 17, a stretchable bottom band 18 adapted to encircle the torso of wearer and back adjustment closure means in the form of a hook 20 and eye 22 arrangement on the distal ends of the side panels 14. Each of the breast retaining cups 12 is defined by a stretchable band 24 above the cup 12 and the stretchable bottom band 18 below the cup 12. Hook arrangement 20 includes at least two hooks 21 (see FIG. 2) and eye arrangement 22 includes at least three pairs of eyelets 23 (see FIG. 1). The bottom band 18, preferably made from an elastic material, provides uplift support for the wearer. The breast retaining cups 12 may be of virtually any style and configuration. For example, they may be made from a stretch cotton or nylon blend or they can be of a rigid polyester material with or without a lining.

As shown in FIG. 1, each of the breast receiving cups 12 includes a stretchable adjustment band 26 which extends inwardly from the inner end of the cup 12. Each adjustment band 26 is defined by an extension of the upper elastic band 24 which is provided along the top portion of the cup 12 and a complimentary lower elastic band 25 which also extends inwardly from the cup 12. A hook member 28 is provided at the distal end of each adjustment band 26. It will be appreciated that other conventional types of fastening means such as, for example, VELCRO fasteners, may likewise be employed.

Figure 3:
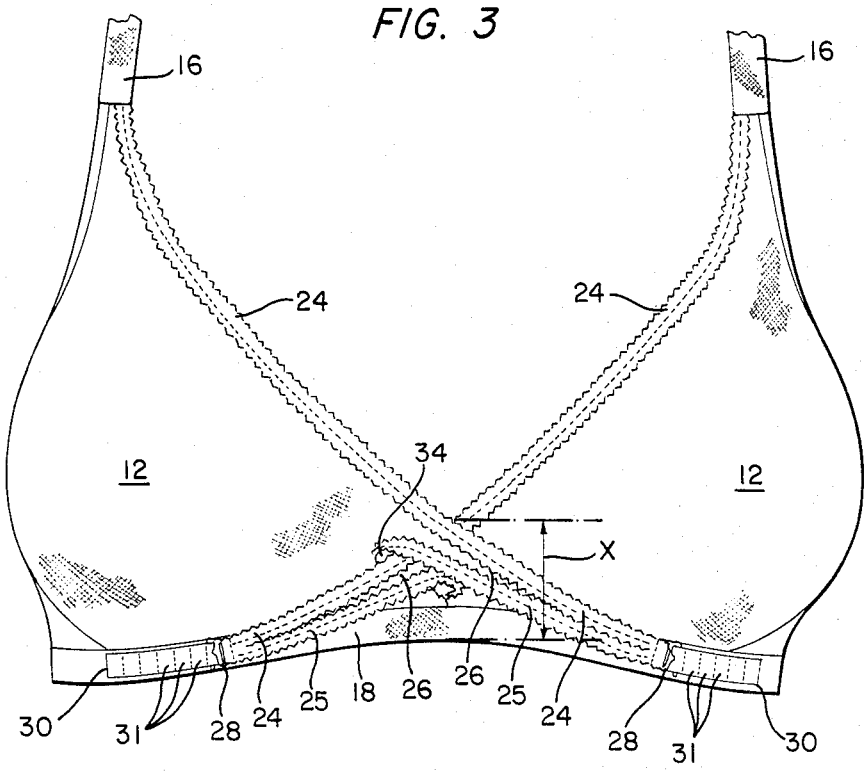
FIG. 3 is a front view of the brassiere of the present invention in an as-worn position adjusted to effect a normal cup separation.
Figure 4:
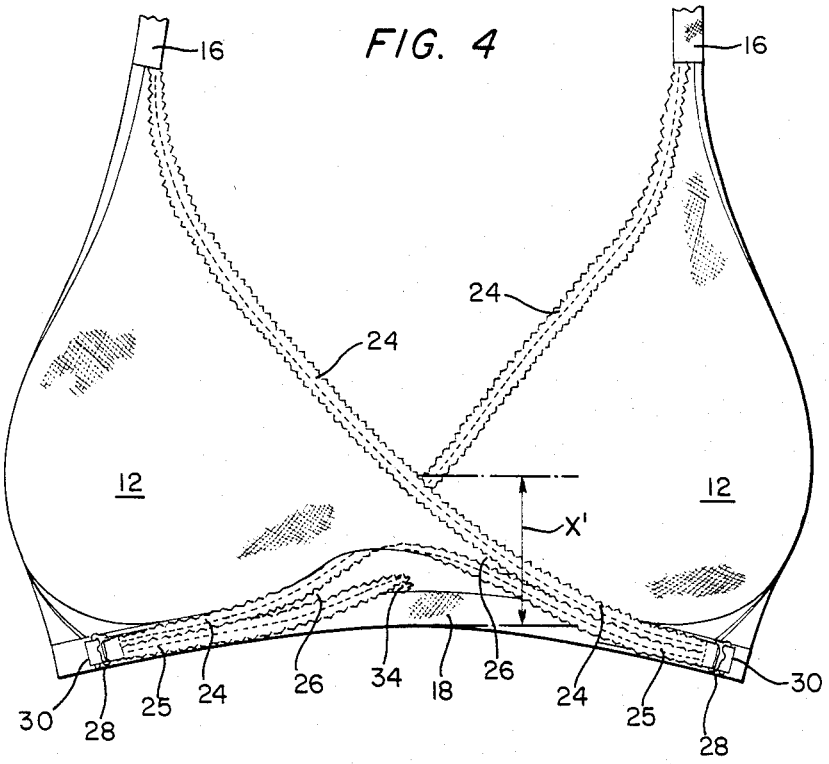
FIG. 4 is a front view of the brassiere of the present invention is an as-worn position adjusted to effect minimal cup separation.
Figure 5:
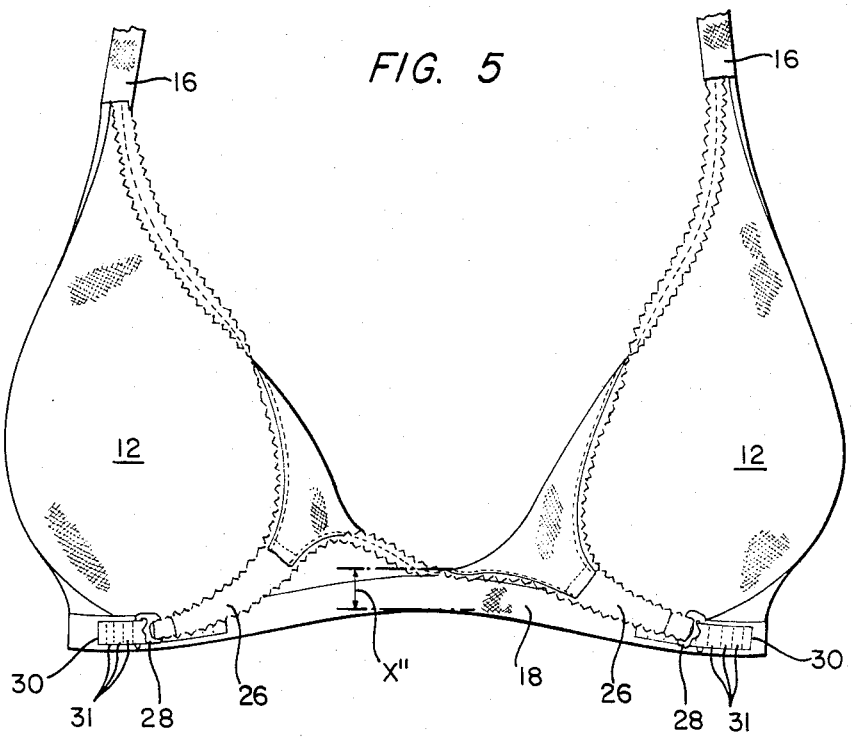
FIG. 5 is a front view of the brassiere of the present invention in an as-worn position adjusted to effect maximum cup separation.

Tapes 30 having a plurality of narrow sleeves or eye members 31 are provided along the bottom band 18 of the brassiere 10 below each of the breast receiving cups 12. The eye members 31 are adapted to engage the corresponding hook member 28 from either the adjustment band 26 which extends inwardly from the opposite breast retaining cup 12 as shown in FIGS. 3 and 4 or from the adjustment band 26 which extends from the breast retaining cup 12 above the tape 30 as shown in FIG. 5.

A plurality of eye members 31 are provided along the length of the tape 30 to permit varied adjustment of the size or volume of each of the breast receiving cups 12. When the brassiere 10 is adjusted in the manner illustrated in FIGS. 3 and 4 wherein the adjustment bands 26 are fastened to the eye members 31 on the tape 30 below the opposite breast retaining cup 12, the adjustment bands 26 overlap one other. Due to the unique configuration of the adjustment bands 26, when the bands overlap one another a slot 34, is formed above the center band 18 and between the breast retaining cups 12 through which one of the adjustment bands 26 passes as it overlaps the other band 26. This slot 34 which is formed by the overlap of the adjustment bands 26, is seen, in particular, in FIG. 2.

The volume or size of each or both breast retaining cups 12 may be adjusted by repositioning the hook members 28 on the corresponding eye members 31. By providing two separate adjustments for cup volume, it will, of course, be appreciated that the volume of one cup 12 may be adjusted independently from the volume of the other cup 12 to provide a degree of balance for the wearer.

It will, of course be appreciated that back width, i.e. the circumference of the brassiere 10 around the wearer's back, can be adjusted independently from that of the size or volume of the breast retaining cup 12. Back width is adjusted by use of the adjustable hook and eye back closure means 20 and 22. Thus, the brassiere can be independently adjusted to accommodate for breast size and fullness totally independent of the wearer's back width.

FIGS. 3–5 illustrate certain of the various forms which the brassiere 10 of the present invention can take in an as-worn position. FIG. 3 illustrates the adjustable brassiere 10 in a relatively normal, as-worn position. As can be seen, the hook members 28 of the adjustment bands 26 are secured to the innermost eye member 31 on the tape 30 below the opposite breast retaining cup 12. In this form, the volume of each breast retaining cup 12 is relatively full and the center height X of the brassiere 10 between the breast retaining cups 12 is reduced (particularly relative the position of FIG. 4). In addition, breast separation and cleavage is increased. The position of FIG. 3 would accommodate a woman having a fuller bust who desires to use the garment under a top or dress with a relatively low neckline.

FIG. 4 illustrates the brassiere 10 of the present invention adjusted to effect minimum cup size or volume, minimum breast separation and maximum coverage. This position is accomplished by securing the hook members 28 of the adjustment bands 26 to the outermost eye members 31 of the tape 30 provided below the opposite breast retaining cups 12. As a result, the volume of the breast retaining cups 12 are reduced and breast separation or cleavage is minimized. Additionally, garment coverage is increased. Note that the center height X′ of the garment is increased over that of the position of FIG. 3. Consequently, the garment would not be intended to be worn under a top or dress having a relatively low neckline.

As illustrated in FIG. 5, the brassiere 10 may be further adjusted to effect maximum cup 12 volume and breast separation and cleavage. In such position, the garment could be worn under an outer garment with an especially low neckline. In the position of FIG. 5, the adjustment bands 26 are not secured to the eye members 31 of the tape 30 below the opposite breast retaining cup 12 but, rather, are attached to the eye member 31 of the tape 30 below their own breast retaining cup 12. The adjustment bands 26 are thus folded over and the hook members 28 at their ends are secured to the eye members 31 of the tape 30 below their own breast retaining cup 12. In such a manner, the cup volume and breast separation and cleavage are maximized while garment coverage, i.e., the center height X″ of the garment, is minimized. This permits the brassiere 10 to be able to be worn under deep plunge tops and dresses.

It will be appreciated that the brassiere 10 of the present invention provides virtually universal adjustability. By the use of the adjustment bands 26, the volume or size of one or both breast retaining cups 12 can be independently adjusted to accommodate individual figure variations. By providing a separate back width adjustment, the back width or circumference of the garment may be adjusted independently from the size or volume of each breast retaining cup 12. Further, garment coverage, i.e., the center height X, may also be adjusted using the adjustment bands 26. Still further, the adjustment means 17 on the straps 16 permits adjustment of the height of the brassiere 10. As a result of all of these different, independent, adjusting features, it will be recognized that the adjustable brassiere 10 of the present invention is a garment which can be worn by a wide variety of women and under a wide variety of different garments.

The following example serves to illustrate the adjustability feature of the present invention and should not be construed as limiting its scope.

EXAMPLE

As is well known in the brassiere manufacturing industry, when a brassiere style is being developed, it is initially fitted to a particular size. The size which is customarily used is size 34B because it is considered to be generally representative of the most commonly worn size brassiere. The accepted industry measurements includes two around the body measurements. The first is the diaphragm measurement which determines the enumerated brassiere size (i.e., 34). This measurement is taken around the body below the breasts. The second is the body chest dimension which is taken around the body along the high points (areola) of the breasts. The actual measurement criteria is described in greater detail in U.S. Pat. No. 4,393,875 which issued on July 19, 1983 to Dolores O'Boyle et al. for a Brassiere, the disclosure of which is hereby expressly incorporated herein by reference thereto.

In order to demonstrate the relative adjustability of the brassiere of the present invention, a sample 34B sized adjustable brassiere worn by a model was adjusted from the "normal" position illustrated in FIG. 3 to the minimal separation position of FIG. 4. Measurements were taken between the respective "high points" of the breast retaining cups 12 in both positions as well as the respective center heights X and X′ in said positions. In the minimal separation position of FIG. 4, the distance between the high points was $7\frac{3}{4}$ inches and the center height X′ was $1\frac{7}{8}$ inches. When the brassiere was adjusted by securing the hook members 28 to the innermost eye members 31 as shown in FIG. 3 so as to permit wider separation of the breasts, the distance between the high points was increased to 9 inches while the center height X was reduced to $1\frac{1}{2}$ inches. The brassiere was then further adjusted to permit maximum cup volume and separation and minimum coverage by securing the hook members 28 of the adjustment bands to the eye members 31 of the tape 30 below their own cups 12 as shown in FIG. 5. In this position, the center height X″ of the brassiere 10 was reduced to $\frac{1}{2}$ inch and the distance between the high points was increased to $9\frac{1}{2}$ inches.

Although the foregoing example illustrates a particular preferred embodiment of the present invention, it will be appreciated that various modifications can be made without departing from the scope of the invention as defined in the claims.

Wherefore, I claim:

1. An adjustable brassiere including:

two independent breast retaining cups, each of said cups having at least one adjusting band including, fastening means at a remote end thereof;

a body encircling band attached to said breast retaining cups along their bottom edges and having adjustable back closure means adapted to permit a wearer to adjust the brassiere to accommodate different back widths; and securing means provided at multiple positions around said body encircling band, said fastening means being adapted to engage said securing means at one of said multiple positions, wherein the volume of each of the breast retaining cups and the amount of garment coverage are determined by the position at which the fastening means at the end of its adjusting band engages the securing means.

2. The brassiere according to claim 1 wherein the adjusting band is stretchable.

3. The brassiere according to claim 1 wherein the fastening means on said adjusting band is a hook.

4. The brassiere according to claim 1 wherein the body encircling band is stretchable.

5. The brassiere according to claim 1 wherein the adjustable closure means comprises an adjustable hook an eye back closure.

6. The brassiere according to claim 3 wherein said securing means comprises at least one tape positioned beneath each of the breast retaining cups.

7. The brassiere according to claim 6 wherein each of said tapes includes a plurality of eye members provided in different positions along the longitudinal length of the tape, each of said eye members being adapted to engage said fastening means.

8. The brassiere according to claim 7 wherein the volume of each of said breast retaining cups may be adjusted by causing the hook of the adjusting band to engage a different eye member.

9. The brassiere according to claim 1 wherein said fastening means and said securing means are VELCRO strips.

10. The brassiere according to claim 1 wherein the securing means are provided on the body encircling band beneath each of the breast retaining cups.

11. The brassiere according to claim 10 wherein the fastening means for each the adjusting band is adapted to engage the securing means provided beneath the opposite breast retaining cup.

12. The brassiere according to claim 10 wherein the fastening means for each adjusting band is adapted to engage the securing means provided beneath its own breast retaining cup.

13. An adjustable brassiere including:

two independent breast retaining cups, each of said cups having at least one adjusting band attached thereto for use in controlling the volume of said cup and breast separation for the wearer;

fastening means attached to the unattached remote end of each of said adjusting bands, said fastening means including at least one fastening hook;

a stretchable body encircling band attached to said breast retaining cups along the bottom edges thereof and including adjustable back closure means to permit the brassiere to be adjusted to accommodate for differing back widths;

securing tapes provided on the body encircling band below each of said breast retaining cup, said tapes each including a plurality of eye members at different positions along the length of said tape, each of said eye members adapted to engage the fastening hook at the end of either of said adjusting bands, wherein the volume of each of the breast retaining cups and the amount of breast separation achieved is determined by the position at which the fastening hook is secured to the eye member and wherein the cup volume and the amount of breast separation may be adjusted by resecuring the fastening hook to a different eye member.

* * * * *